US010879617B1

(12) United States Patent
Rivera

(10) Patent No.: US 10,879,617 B1
(45) Date of Patent: Dec. 29, 2020

(54) WIDEBAND SLOT ANTENNA WITH INTERDIGITAL BACK PLANE

(71) Applicant: The United States of America as represented by the Secretary of the Navy, Newport, RI (US)

(72) Inventor: David F Rivera, Westerly, RI (US)

(73) Assignee: The United States of America as represented by the Secretary of the Navy, Newport, RI (US)

( * ) Notice: Subject to any disclaimer, the term of this patent is extended or adjusted under 35 U.S.C. 154(b) by 0 days.

(21) Appl. No.: 16/527,447

(22) Filed: Jul. 31, 2019

(51) Int. Cl.
*H01Q 13/12* (2006.01)
*H01Q 1/36* (2006.01)
*H01Q 9/06* (2006.01)

(52) U.S. Cl.
CPC ..... *H01Q 13/12* (2013.01); *H01Q 1/364* (2013.01); *H01Q 9/06* (2013.01)

(58) Field of Classification Search
CPC ..... H01Q 13/12; H01Q 9/06; H01Q 1/364
See application file for complete search history.

(56) References Cited

U.S. PATENT DOCUMENTS

2016/0240925 A1* 8/2016 Xue ..... H01Q 13/206

* cited by examiner

*Primary Examiner* — Seokjin Kim
(74) *Attorney, Agent, or Firm* — James M. Kasischke; Michael P. Stanley

(57) ABSTRACT

An antenna is provided with a plurality of spaced-apart interdigital back plates covered by a slotted plate having a longitudinal slot of varying rectangular parameters. A plurality of spacers are positioned between the interdigital back plates and the slotted plate. A support stiffener connects the interdigital back plates at a trough of each back plate with three rectangular stanchions extending perpendicular from the support stiffener to attach to the slotted plate. A feed point is positioned on a central rectangular stanchion and beneath a central slot of the slotted plate. A feed cowl protects the feed point. The sizing of a slot in the slotted plate depends on an operating wavelength.

6 Claims, 16 Drawing Sheets

WIDEBAND SLOT ANTENNA WITH INTERDIGITAL BACK PLANE

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION

(1) Field of the Invention

The present invention relates to antennas, and more particularly to a slot antenna.

(2) Description of the Prior Art

An antenna which can operate over wide bandwidths is desirable for many reasons. One reason is that a wide bandwidth antenna can replace narrow bandwidth antennas tuned over the same bandwidth. A second reason is that a wide bandwidth antenna permits simultaneous receive-transmit functions over a prescribed frequency band.

In the prior art, particularly in the area of slotted antennas, there have been various methods of producing different beam pattern shapes and wide impedance bandwidths. The limitation of these methods has been a requirement that the antenna operate above a cutoff frequency. The cutoff frequency is the frequency where the antenna ceases to operate.

The cutoff frequency depends on the cross-sectional properties of the antenna. The properties are slot width (w), mean radius (a) and cylinder wall thickness (t). A formula for a cutoff wavelength $\lambda_c$ of a slotted cylinder antenna has been derived and is expressed in Equation (1) as $$\lambda_c \approx 2a[1+3\sqrt{(\pi t/w)}+2(1+\ln(a/w))] \quad (1)$$

The cutoff frequency $f_c$ is then determined with the well-known frequency/wavelength conversion formula of Equation (2)

$$\lambda = \frac{v_o}{f} \quad (2)$$

where $\upsilon_o$ is the speed of light $3\times10^8$ meters/sec).

Examining the cutoff wavelength formula indicates a fundamental about the proper operation of the antenna. That is, if the cylinder wall thickness (t) and the slot width (w) are held constant; higher cutoff frequencies would require smaller diameter tubes and lower frequencies would require larger diameter tubes.

A typical slotted-cylinder antenna has a slot width that is uniform and operates over a frequency bandwidth of at most ±20% from the center design frequency and depends on a length-to-width ratio of the slot for a given cylinder diameter and wall thickness.

In the typical antenna with uniform slot width, the cylindrical section affects the slot impedance and radiation pattern. The shape of the radiation pattern in the horizontal plane changes with the ratio of the perimeter-to-wavelength (p/λ). For small p/λ (<0.3), the antenna pattern is omnidirectional; antennas with larger values of p/λ have more directional patterns, the main beam lobe emanating from the slot region.

As such, there is a continuing need for a smaller diameter slotted antenna that be used at lower frequencies. There is an additional need for a slotted antenna that yields a wide impedance bandwidth.

SUMMARY OF THE INVENTION

It is therefore a primary object and a general purpose of the present invention to provide a slot antenna that operates over a large bandwidth with an impedance match and radiation beam patterns with a moderately high gain.

To attain the object of the present invention, a slot antenna is provided to include a metal cavity behind the slot. The longitudinal slot is configured with aligned rectangular apertures of varying parameters. Each of the rectangular apertures is sized based on an operational frequency.

The metal cavity comprises a series of spaced-apart interdigital back plates. A feed point is attached to a support stiffener that connects the interdigital back plates with the feed point positioned beneath a central location of the slot.

The interdigital plates can modify the wave propagation properties of the slot. This is because the shape of the slot controls the impedance at the feed terminal (located at the center of the slot) to a level that is acceptable to load, such as a receiver or transmitter, over a very wide frequency bandwidth (a frequency ratio $F_{high}/F_{low}$ of about 3:1).

In a typical slotted-cylinder antenna with uniform slot width, the cylindrical section affects the slot impedance and radiation pattern. A plate in the present application affects only the radiation pattern but not the slot impedance in a noticeable way.

In both cases, the shape of the radiation pattern in the horizontal plane changes with the ratio of the perimeter-to-wavelength (p/λ). For small p/λ (<0.3), the antenna pattern is omnidirectional; antennas with larger values of p/λ have more directional patterns, the main beam lobe emanating from the slot region.

The slot antenna can be used for applications requiring wideband performance in a slender silhouette. Wideband performance is determined by the impedance behavior of the slot over a range of frequencies. At low frequencies the perimeter-to-wavelength ratio (p/λ) of the antenna is small, meaning that the antenna is electrically slender, so the pattern in the horizontal plane is omnidirectional.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
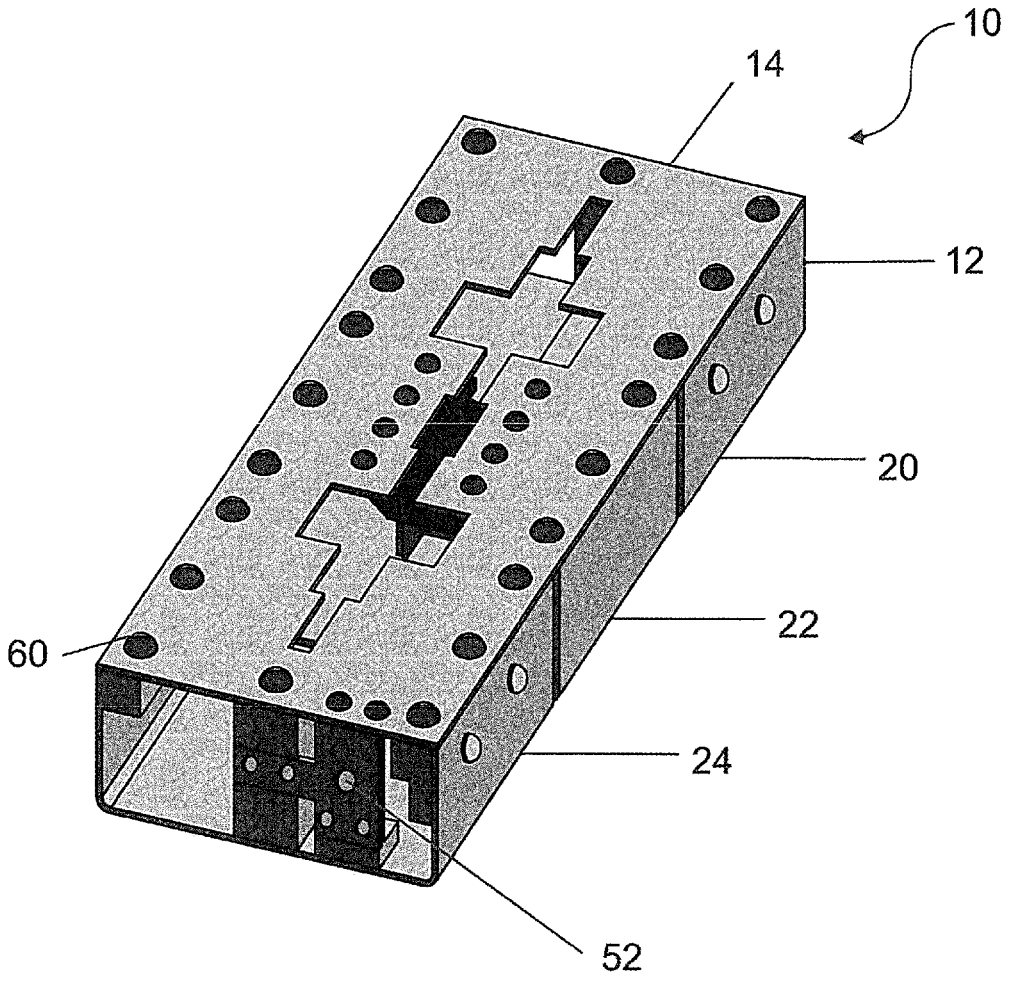
FIG. 1 depicts an assembled slot antenna of the present invention.

Referring now to the drawings, FIG. 1 depicts an assembled slot antenna 10 of the present invention. As shown by an exterior of the slot antenna 10, the antenna comprises a first section 12 and a slotted plate or a second section 14. The first section 12 comprises a first interdigital back plate 20, a second interdigital back plate 22 and a third interdigital back plate 24 with the slotted plate 14 affixed to the back plates. A feed port 52 extends from a first end of the slot antenna 10 and is capable of energizing the whole antenna. Numerous fasteners 60 secure the various components of the slot antenna 10.

Although fabricated from aluminum, brass and plastic composites, the slot antenna 10 can be made from other materials to withstand environmental elements or other considerations. The parts to the slot antenna 10 are shown positioned for assembly in FIGS. 2-8.

Figure 2:
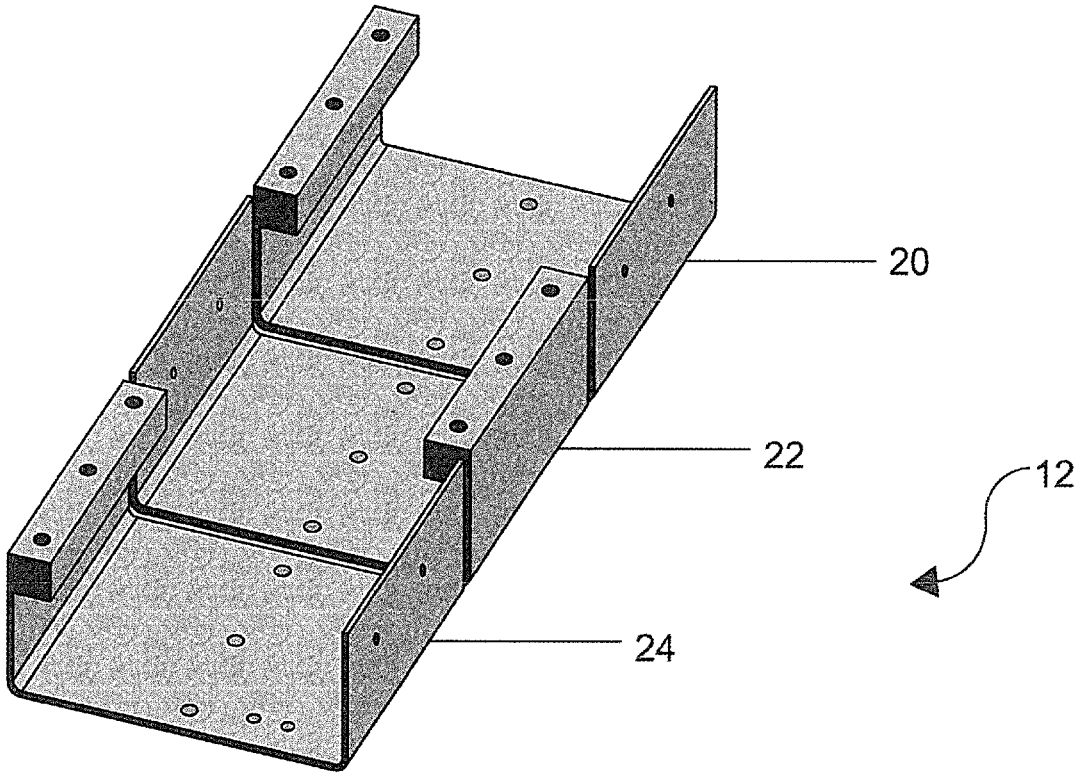
FIG. 2 depicts an arrangement of interdigital back plates that form a first section of the slot antenna.

FIG. 2 depicts the positioning of the U-shaped first interdigital back plate 20, the U-shaped second interdigital back plate 22 and the U-shaped third interdigital back plate 24 as part of the first section 12. Each of the first interdigital back plate 20, the second interdigital back plate 22 and the third interdigital back plate 24 has a machined flat (with three threaded holes) on one side of the U-shape and a simple edge on the other side of the U-shape. Each machined flat is connected to the slotted plate 14 on alternating sides with fasteners 60. "Interdigital" refers to the appearance of the mounted U-plates since the attachment points are on opposite sides of the first interdigital back plate 20, the second interdigital back plate 22 and the third interdigital back plate 24. The first interdigital back plate 20, the second interdigital back plate 22 and the third interdigital back plate 24 are made with aluminum and are spaced apart to create an electrical equivalent circuit.

At their planar ends, the first interdigital back plate 20, the second interdigital back plate 22 and the third interdigital back plate 24 are spaced apart from each other. The first interdigital back plate 20, the second interdigital back plate 22 and the third interdigital back plate 24 include numerous fastener apertures for assembly.

Figure 3:
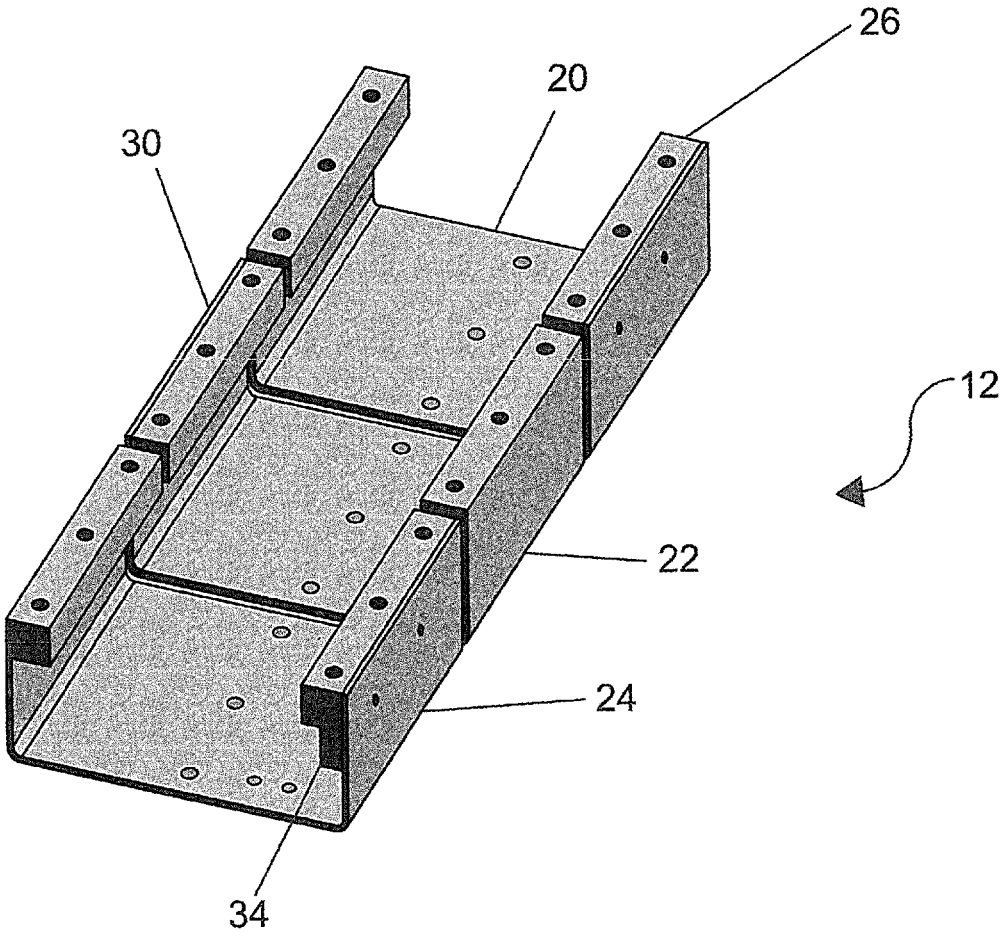
FIG. 3 depicts the interdigital back plates with an addition of spacer plates.

FIG. 3 depicts the positioning of a first insulator spacer 26 affixed to the first interdigital back plate 20. A second insulator spacer 30 is affixed to the second interdigital back plate 22. A third insulator spacer 34 is affixed to the third interdigital back plate 24. The first insulator spacer 26, the second insulator spacer 30, and the third insulator spacer 34 includes numerous fastener apertures for assembly with the slotted plate 14. The insulator spacers are made from fiberglass and are attached to the simple edges of the U-shaped interdigital plates using screws or bolts on the sides of the plates.

Figure 4:
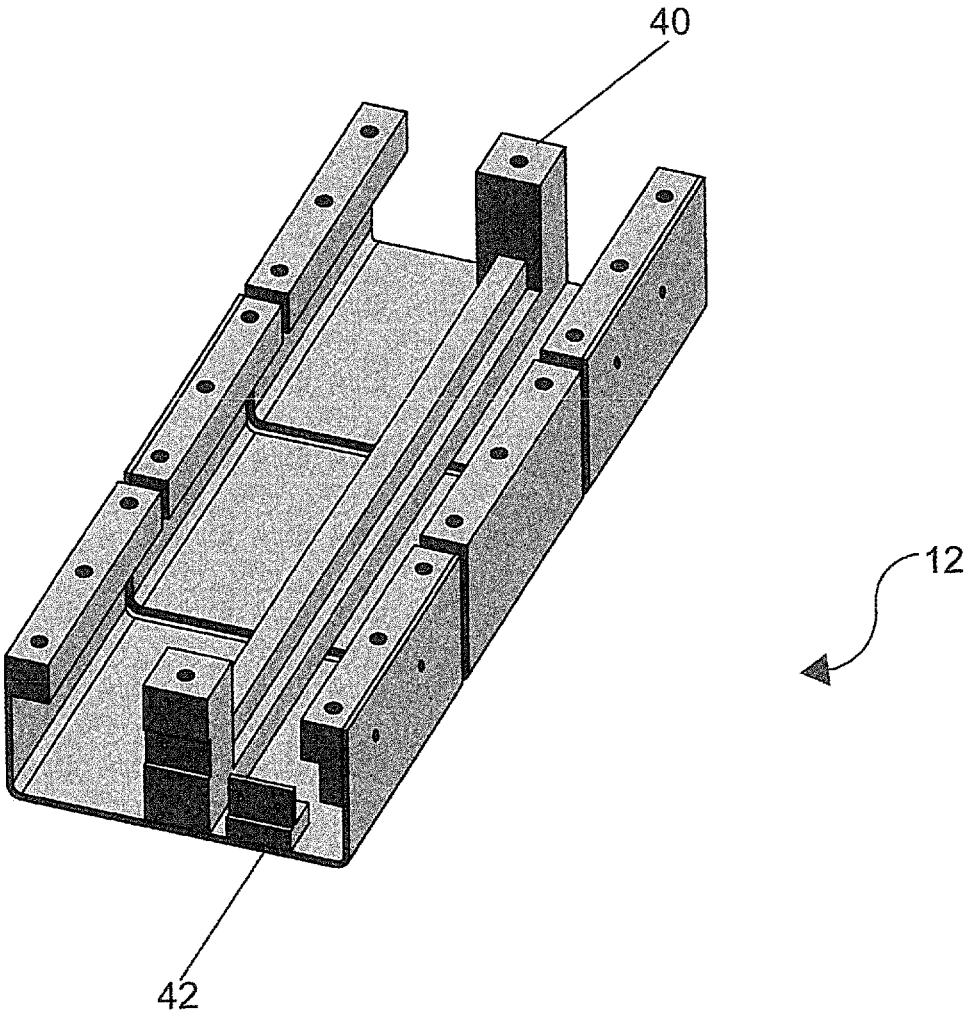
FIG. 4 depicts the first section with an addition of a support stiffener and a feed port bracket standoff.

FIG. 4 depicts the addition of a support stiffener 40 and feed port bracket standoff 42 as part of the first section 12. The support stiffener 40 and the feed port bracket standoff 42 include fastener apertures for assembly with the support stiffener and the feed port bracket standoff made from fiberglass.

Figure 5:
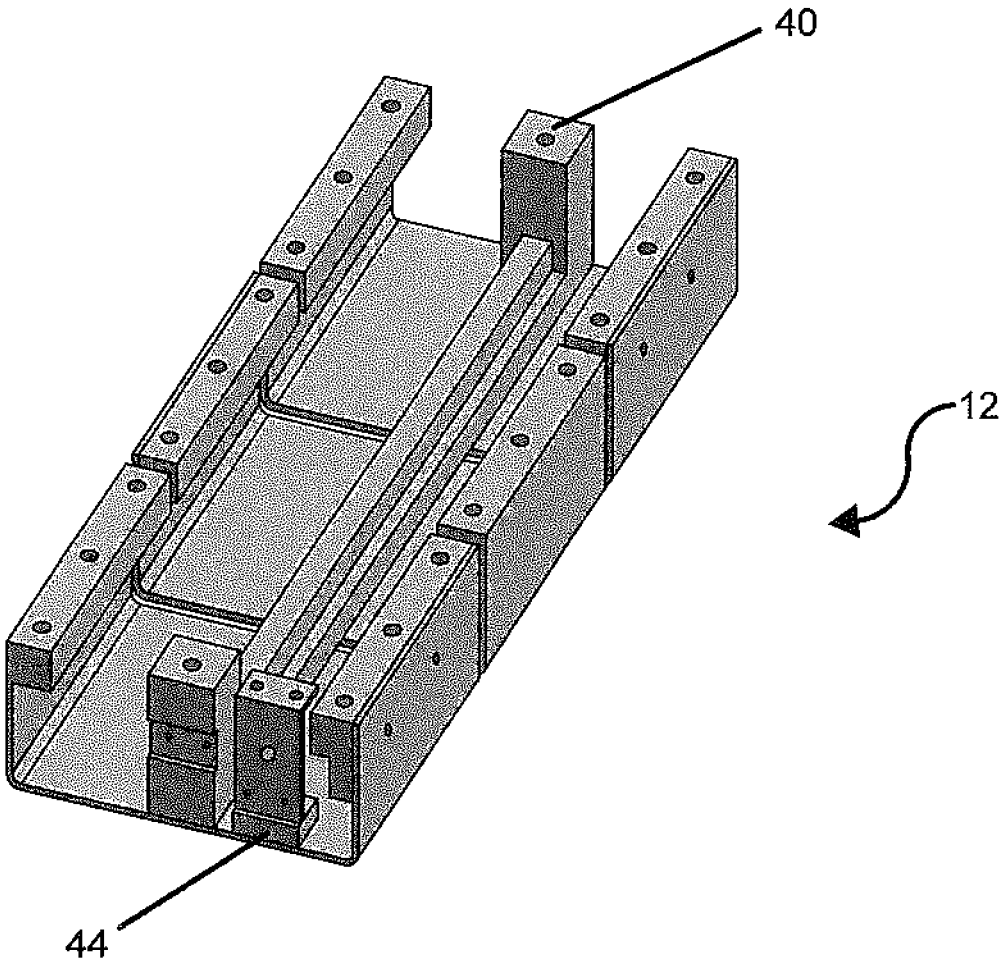
FIG. 5 depicts the feed port bracket standoff with an addition of a feed port support bracket.

FIG. 5 depicts the positioning of a feed port support bracket 44 as part of the first section 12. The feed port support bracket 44 includes fastener apertures for assembly with the feed port support bracket made from aluminum.

Figure 6:
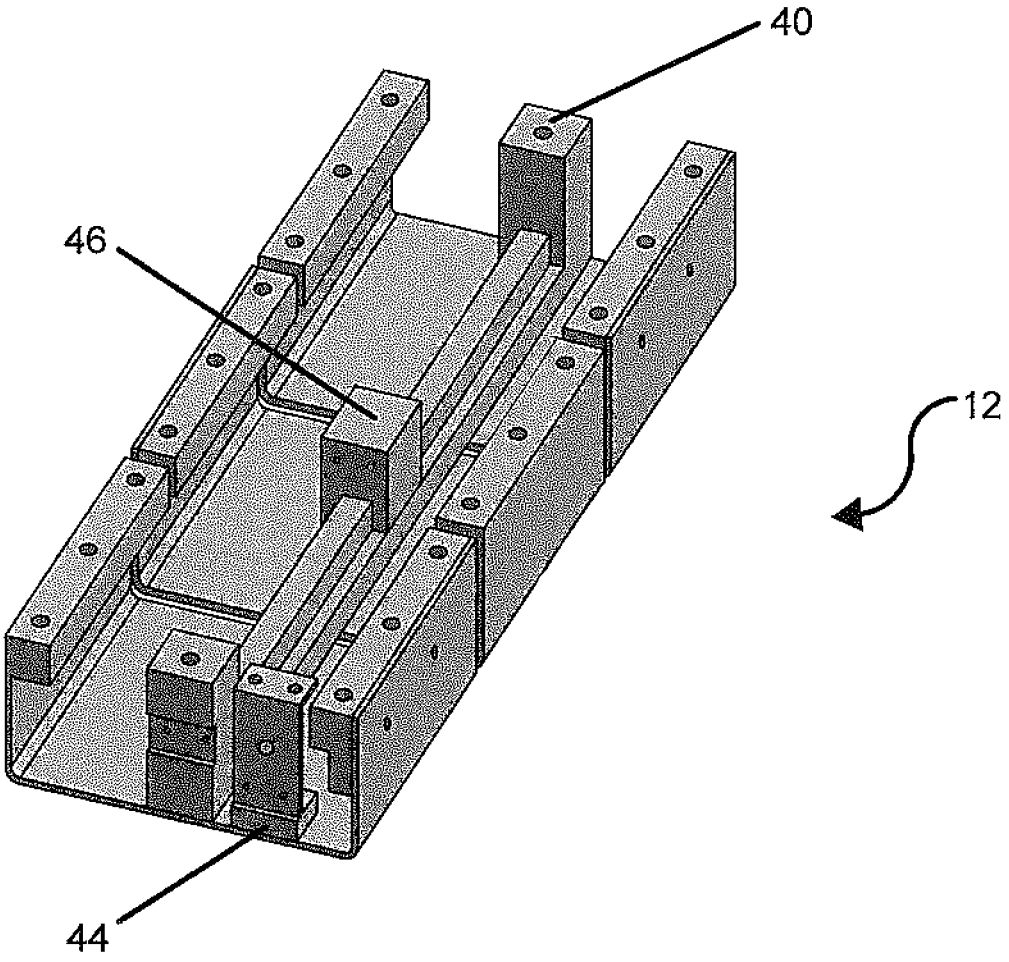
FIG. 6 depicts the first section with an addition of a support stanchion for a feed region at a slot center.

FIG. 6 depicts the positioning of a center support 46 on the support stiffener 40. The center support 46 includes fastener apertures for assembly with the center support made from fiberglass.

Figure 7:
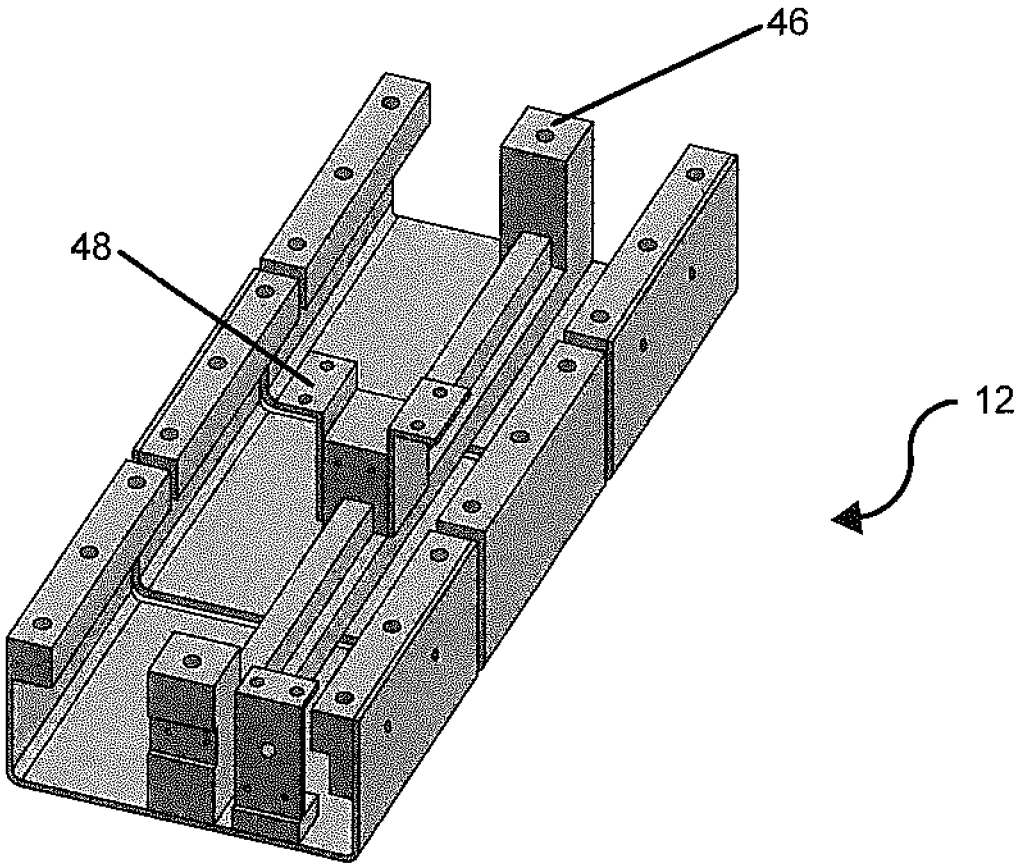
FIG. 7 depicts the first section with an addition of a slot center feed.

FIG. 7 depicts the positioning of a feed point 48 on the center support 46. The feed point 48 is a simple cone. The feed point 48 includes fastener apertures for assembly with the feed point made from brass.

Figure 8:
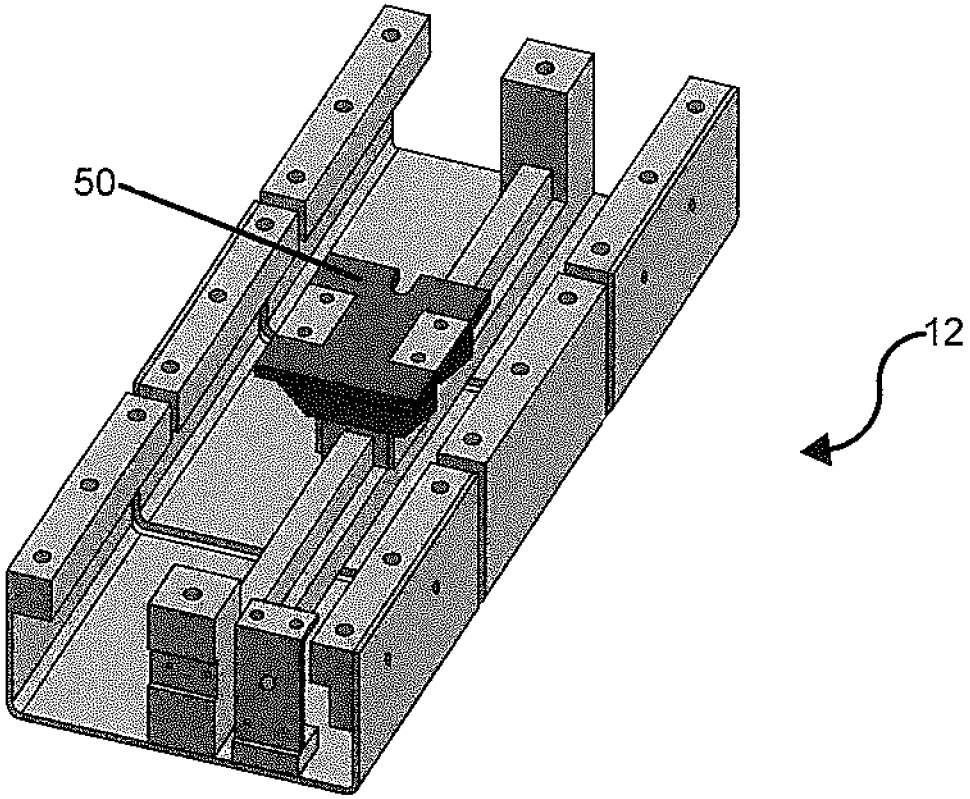
FIG. 8 depicts the first section with an addition of a feed cowl.

FIG. 8 depicts the positioning of a feed cowl 50 as a protective cover for the feed point 48. The feed cowl 50 can slip on the feed point 48 with the feed cowl preferably made of a Noryl polymer. The feed cowl is a plastic cover that contributes some support and prevents dirt from entering a feed region of the antenna 10.

Figure 9:
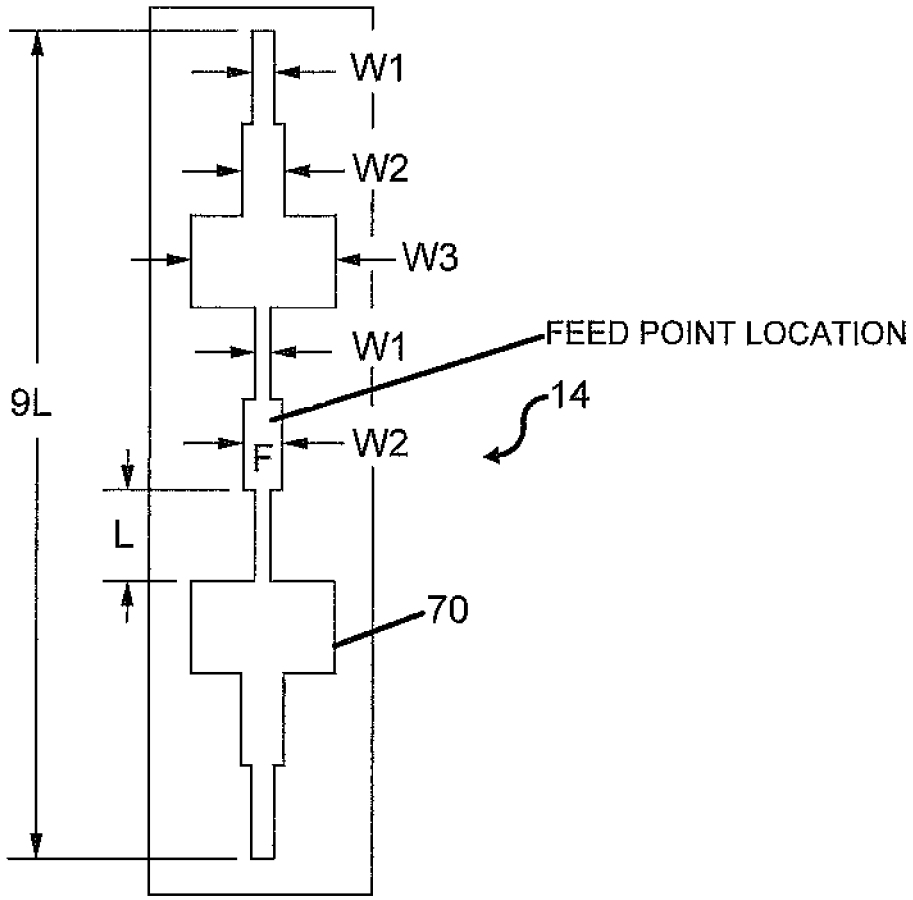
FIG. 9 depicts a configuration of a slotted plate with wideband slot.

The slotted plate or the second section 14 is shown secured by the fasteners 60 in FIG. 1. The sizing of a slot 70 in the slotted plate 14 is shown in FIG. 9 with the sizing of the slot depending on the operating wavelength λ and calculated by Equation (3)

$$\lambda = \frac{v_o}{f} \tag{3}$$

where $\upsilon_o$ is the speed of light and f is the operating frequency.

The feed point 48 of FIG. 7 spans the width of the slot 70. One end of the cone of the feed point 48 is grounded to the slotted plate 14 and is attached. The other end of the cone is connected to a center pin of a coaxial connector. An outside metallic shell of the coaxial connector makes contact with the slotted plate 14. In this way, a source of radio-frequency power can be applied across the connector to energize the slot 70. The feed point 48 is placed centrally along a length of the slot 70 so that the resulting radiation in the vertical plane is balanced—that is to prevent the beam pattern from tilting to one end of the slot.

The operating frequency of the slot 70 is actually the center of the operating band (that is, f=F0). Dimensions of the slot 70, as represented in FIG. 9, are W1=λ/33, W2=λ/17, W3=λ/5 and L=λ/8. The slot 70 is divided into nine sub-lengths of length "L". Each sub-length measures λ/8 where λ is the wavelength at the center of the operating band. The total slot length is therefore 9L or 9λ/8 at the band center.

For understanding the electrical behavior of the slot antenna 10, a focus should be on the Voltage Standing Wave Ratio. The Voltage Standing Wave Ratio (VSWR) is a measure of how closely matched the slot antenna 10 is to a transmitter or a receiver having a nominal 50-ohm impedance. A VSWR of unity is considered a perfect match but is rarely met in practice.

For the slot antenna 10, the VSWR is satisfactory for any application. In practical terms, the VSWR provides information about the loss in power transfer between the slot antenna 10 and the receiver or transmitter due in a mismatch in impedance. The mismatch M (in dB) is given by Equation (4)

$$M = 10\log\left[\frac{4S}{(S+1)^2}\right] \tag{4}$$

where S is the VSWR of the slot antenna 10.

Another focus can be on radiation beam patterns and realized gain. The radiation beam patterns for the slot antenna 10 are generally toroidal in shape and surround the structure of the slot antenna with the beam patterns retaining shape over numerous operational frequency ranges. With extremes in frequency, the shape of the beam patterns change slightly.

The operation of the slot antenna 10 is explained by simple electrical equivalent circuits which are derived by supposing that the shape of the slot 70 is made of a wire (or band) of infinitesimal diameter and that the slotted plate 14 as well as the first interdigital back plate 20, the second interdigital back plate 22 and the third interdigital back plate 24 are connected to the thin-wire slot.

The slotted plate as well as the first interdigital back plate 20, the second interdigital back plate 22 and the third interdigital back plate 24 are conceptually removed; thereby, leaving behind the thin-wire slot intact and isolated in space. The wire-frame structure left behind is essentially a parallel-wire transmission line with a varying wire separation along a length with short circuits at each end.

Figure 10:
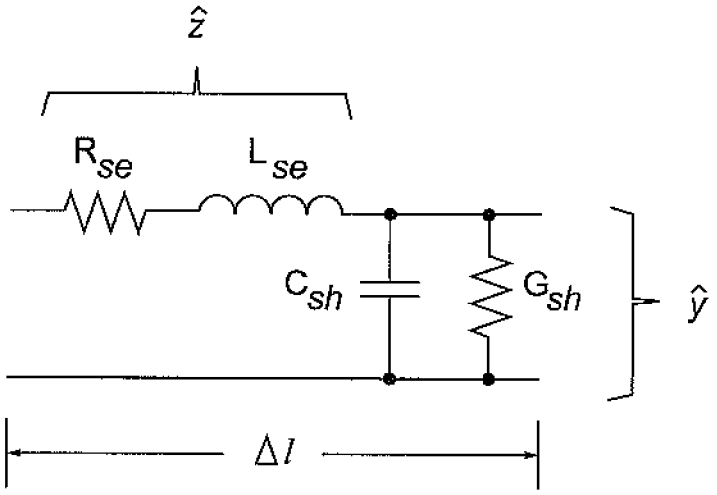
FIG. 10 depicts an electrical equivalent circuit of a sub-length of the slot configuration.

With a sinusoidal voltage source connected across conductors at the midpoint of the slot length, currents will flow along the wires and establish magnetic lines of force around each conductor and electric field lines arcing across the parallel wires of transmission line. Because a cross-section of the transmission line is a fraction of the operating wavelength, the line can be represented as the sum of smaller sub-lengths Δl; each sub-length having an electrical equivalent circuit shown in FIG. 10.

In the figure, $R_{se}$ and $L_{se}$ are the per-unit length series resistance and inductance, respectively, and $C_{sh}$ and $G_{sh}$ are the per-unit length shunt capacitance and conductance, respectively. $L_{se}$ represents the energy storage in the magnetic field of the line with $R_{se}$ being an ohmic dissipation. $C_{sh}$ represents the energy storage in the electric field of the line and $G_{sh}$ represents the energy leakage due to imperfect storage of the electric field.

The symbols $\hat{z}$ and $\hat{y}$ are the "n" per-unit length impedance (units: Ohms per meter, Ω/m) and admittance (units: Siemens per meter, S/m), respectively, and are functions of the four equivalent circuit elements ($R_{se}$, $L_{se}$, $C_{sh}$, $G_{sh}$). See Equations (5) and (6)

$$\hat{z}=R_{se}+j\omega L_{se} \tag{5}$$

$$\hat{y}=G_{sh}+j\omega C_{sh} \tag{6}$$

where ω is the angular frequency (ω=2πf) and $j=\sqrt{-1}$.

An important quantity derived from the equivalent circuit is the propagation constant γ defined in Equation (7) as $$\gamma=\alpha+j\beta=\sqrt{\hat{z}\hat{y}} \tag{7}$$

where α and β are the per-unit length attenuation and phase constant, respectively. The two quantities describe the amplitude decay, and indirectly, the velocity of the electromagnetic wave as the wave propagates from the voltage source toward the short circuit and back.

The value of γ for the line above, in terms of the four per-unit length quantities is therefore in Equation (8) as $$\gamma=\sqrt{A+jB} \tag{8}$$

whereas in Equation (9) and Equation (10)

$$A=R_{se}G_{sh}-\omega^2L_{se}C_{sh} \tag{9}$$

$$B=\omega(R_{se}C_{sh}+L_{se}G_{sh}) \tag{10}$$

Quantities A and B are the real and imaginary parts (respectively) of the complex product $\hat{z}\hat{y}$ under the square root which defines the propagation constant γ.

For an ideal line, $R_{se}=0$ and $G_{sh}=0$ and γ attains a value from Equation (11) of $$\gamma=j\omega\sqrt{L_{se}C_{sh}} \tag{11}$$

and in essence that of Equation (12) and Equation (13)

$$\alpha=0 \tag{12}$$

$$\beta=\omega\sqrt{L_{se}C_{sh}} \tag{13}$$

This indicates that wave propagation between the wires of the lossless transmission line travels along the line with no amplitude decay and with a velocity of Equation (14)

$$v=\frac{\omega}{\beta}=\frac{1}{\sqrt{L_{se}C_{sh}}}=v_o \tag{14}$$

where $\upsilon_o$ equates to the speed of light.

Figure 11:
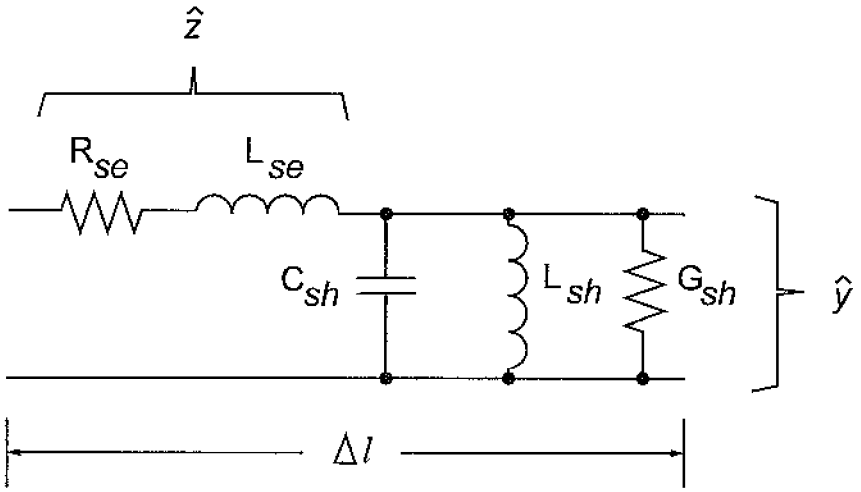
FIG. 11 depicts an electrical equivalent circuit of a slot sub-length with a continuous metal backing.

The parallel-wire transmission is now attached to a metal box (or cylinder) to form an antenna, but without interdigital (open-short) plates. The equivalent circuit of a small length Δl of slot is represented with the circuit in FIG. 11.

In the figure, $L_{sh}$ is the shunt inductance of the box (or tube) that the parallel-line slot electrically "sees". If it is assumed that $R_{se}=0$ and $G_{sh}\neq 0$ (because currents are now generated over a surface of the antenna resulting in radiation), the propagation constant γ attains a value (omitting the intermediate steps) by Equation (15):

$$\gamma=\sqrt{-\omega^2L_{se}C_{sh}\left[1-\frac{1}{(\omega^2L_{sh}C_{sh})}\right]+j\omega L_{se}G_{sh}} \tag{15}$$

using Equation (16)

$$\hat{z}=j\omega L_{se} \tag{16}$$

and Equation (17)

$$\hat{y}=G_{sh}+j\omega C_{sh}+\frac{1}{j\omega L_{sh}} \tag{17}$$

Assuming that in Equation (18)

$$\omega^2 L_{se} C_{sh}\left[1-\frac{1}{(\omega^2 L_{sh} C_{sh})}\right] > \omega L_{se} G_{sh} \tag{18}$$

the propagation constant γ of Equation (19) is approximately $$\gamma \approx \frac{\omega G_{sh}}{2}\sqrt{\frac{L_{se}}{[\omega^2 C_{sh}-(1/L_{sh})]}} + j\omega\sqrt{L_{se} C_{sh}\left[1-\frac{1}{(\omega^2 L_{sh} C_{sh})}\right]} \tag{19}$$

and by Equation (20), the phase constant is $$\beta \approx \omega\sqrt{L_{se} C_{sh}\left[1-\frac{1}{(\omega^2 L_{sh} C_{sh})}\right]} \tag{20}$$

The phase constant indicates that the wave propagation in the slot region depends on the value of $L_{sh}$. Essentially, $L_{sh}$ makes the antenna radiate or activate when the term in the square bracket is positive, that is, when by Equation (21)

$$\omega^2 L_{sh} L_{sh} > 1 \tag{21}$$

and is inactivated or non-radiative, when $\omega^2 L_{sh} C_{sh} \leq 1$ because the amplitude of the propagating wave in the slot region decays rapidly as the wave travels away from the source of energy (the feed point 48).

The condition of Equation (22)

$$\omega^2 L_{sh} C_{sh} = 1 \tag{22}$$

is identified as the cutoff condition and is well-known in the art.

In the present invention, the first interdigital back plate 20, the second interdigital back plate 22 and the third interdigital back plate 24 have alternating gaps along the length of the antenna structure that capacitively couple to the slotted plate 14. The equivalent circuit of a short length λl of slot is shown in FIG. 12.

The circuit of the figure illustrates an effect of the slot 70, which is to maintain wave propagation behavior similar to that found in a simple transmission line, where the phase velocity of the wave in the slot is the same as that of free space. If a solid plate was substituted behind the slotted plate 14; the phase velocity of the propagating wave in the slot region would differ appreciably from that found in free space as described in FIG. 11, such that the physical slot length would need to be longer for the same operating frequency range.

The interdigital plates modify the wave propagation behavior in the slot region to maintain a slot length comparable to the operating wavelength without affecting the radiation pattern in a significant way.

Figure 12:
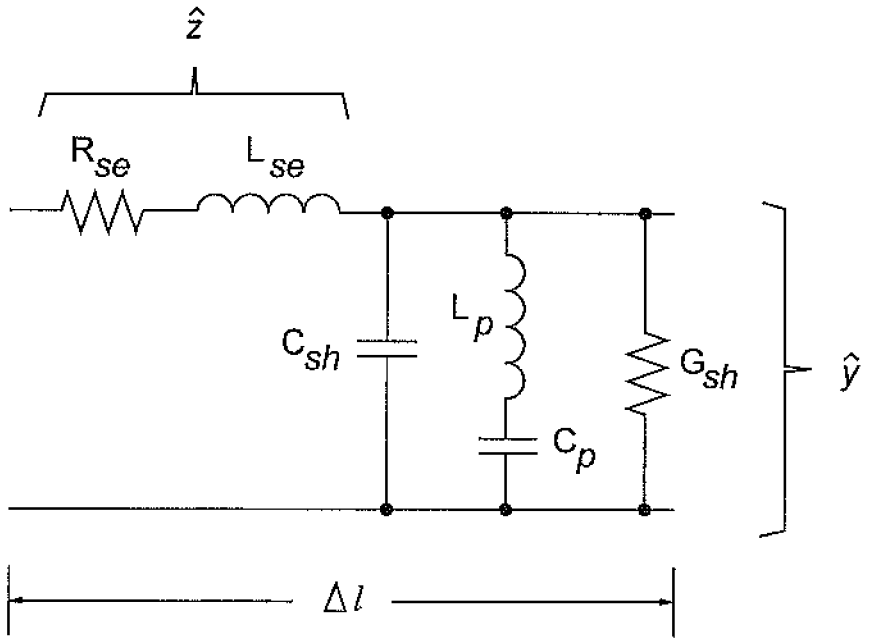
FIG. 12 depicts an electrical equivalent circuit of a slot sub-length with an interdigital metal backing.

In FIG. 12, $L_p$ and $C_p$ represent the inductance of the interdigital plate and the capacitance of the gap, respectively. Assuming that $R_{se}=0$ and $G_{sh}\neq 0$, the propagation constant in the slot region is now (omitting the intermediate steps) detailed in Equation (23)

$$\gamma = \sqrt{-\omega^2 L_{se}\left[C_{sh}+\frac{C_p}{1-\omega^2 L_p C_p}\right] + j\omega L_{se} G_{sh}} \tag{23}$$

which is approximately in Equation (24) as $$\gamma \approx \frac{G_{sh}}{2}\sqrt{\frac{L_{se}}{C_{sh}+\left(\frac{C_p}{1-\omega^2 L_p C_p}\right)}} + j\omega\sqrt{L_{se}\left[C_{sh}+\left(\frac{C_p}{1-\omega^2 L_p C_p}\right)\right]} \tag{24}$$

using Equation (25)

$$\hat{z} = j\omega L_{se} \tag{25}$$

and by Equation (26)

$$\hat{y} = G_{sh} + j\omega C_{sh} + \left(\frac{1}{j\omega L_p + \frac{1}{j\omega C_p}}\right) \tag{26}$$

so that the phase constant now has the form by Equation (27)

$$\beta \approx \omega\sqrt{L_{se}\left[C_{sh}+\left(\frac{C_p}{1-\omega^2 L_p C_p}\right)\right]} \tag{27}$$

The result above states two important facts in that when $\omega^2 L_p C_p \ll 1$, as would likely be the case when the interdigital plate length is small, the slot antenna 10 does not have a cutoff frequency and that the wave propagation in the slot is independent of $L_{sh}$.

The implication is that the use of interdigital plates permits the construction of slotted antennas with very small metal troughs or other back-plane shapes without a concern for cutoff. It also indicates that slot antennas with small metallic backing can be used for low frequency operation if the interdigital technique is employed.

A traditional slotted tube antenna with a small diameter operates at very high frequencies because the cutoff frequency varies inversely with diameter. By using a small diameter interdigital-plate slotted tube antenna; the frequency of operation can be much lower because the slot length is the only controlling factor. This also means that the slot shape can yield a wideband impedance match over the desired frequency range.

Figure 13:
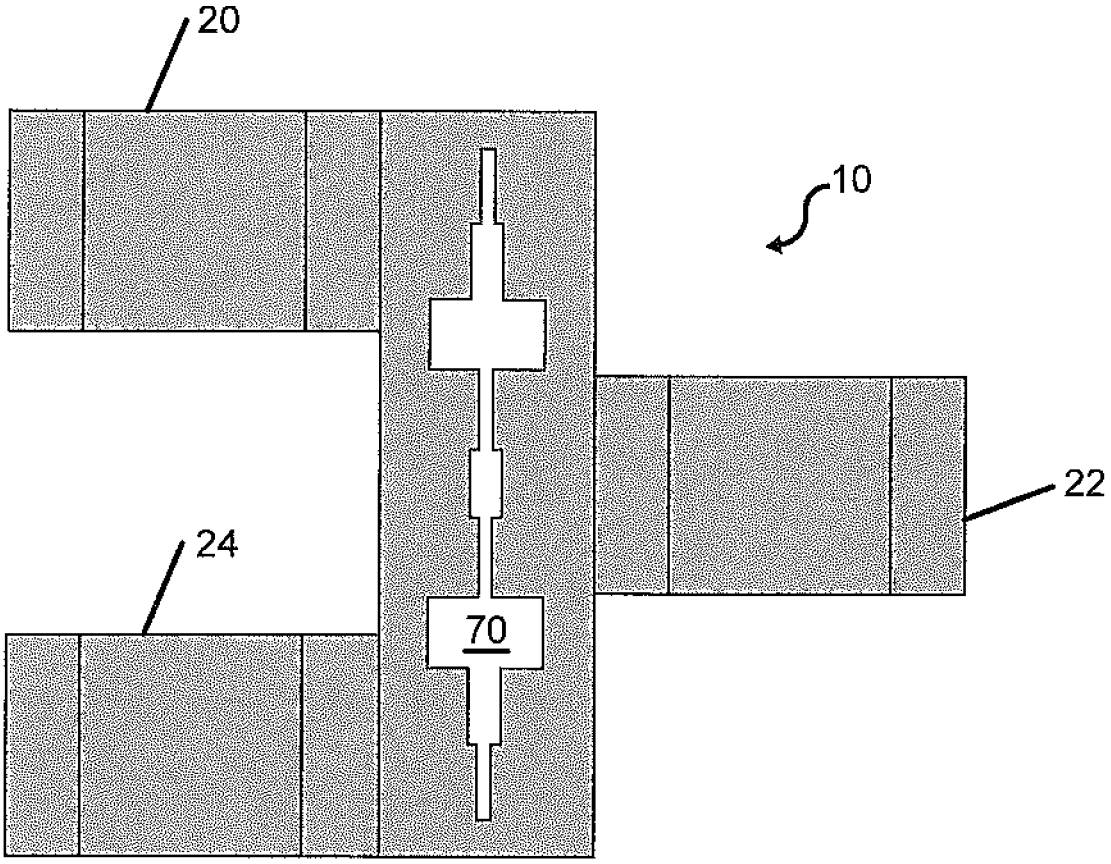
FIG. 13 depicts the slot antenna of the present invention unfurled to show positioning of the slotted plate in relation to the interdigital plates.

The radiation beam pattern produced by the antenna at various frequencies is a result of the way in which electric current spreads over its surface, both in magnitude and direction. FIG. 13 depicts the interdigital arms behind the slot plate unfurled, where the interior lines are locations where there are bends. The current distributions are corresponding to beam patterns referenced earlier are shown in FIG. 14, FIG. 15 and FIG. 16.

Figure 14:
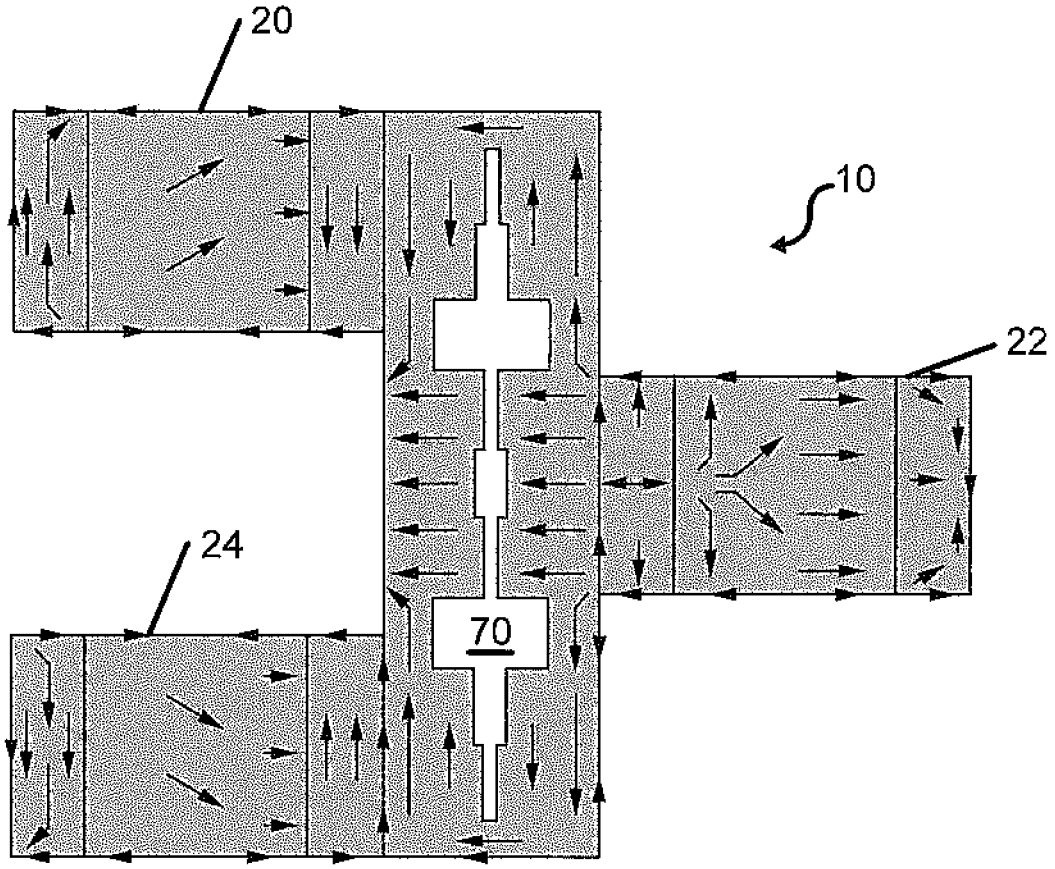
FIG. 14 depicts the slot antenna of the present invention unfurled to show surface current distribution at a frequency of 0.63 F0.
Figure 15:
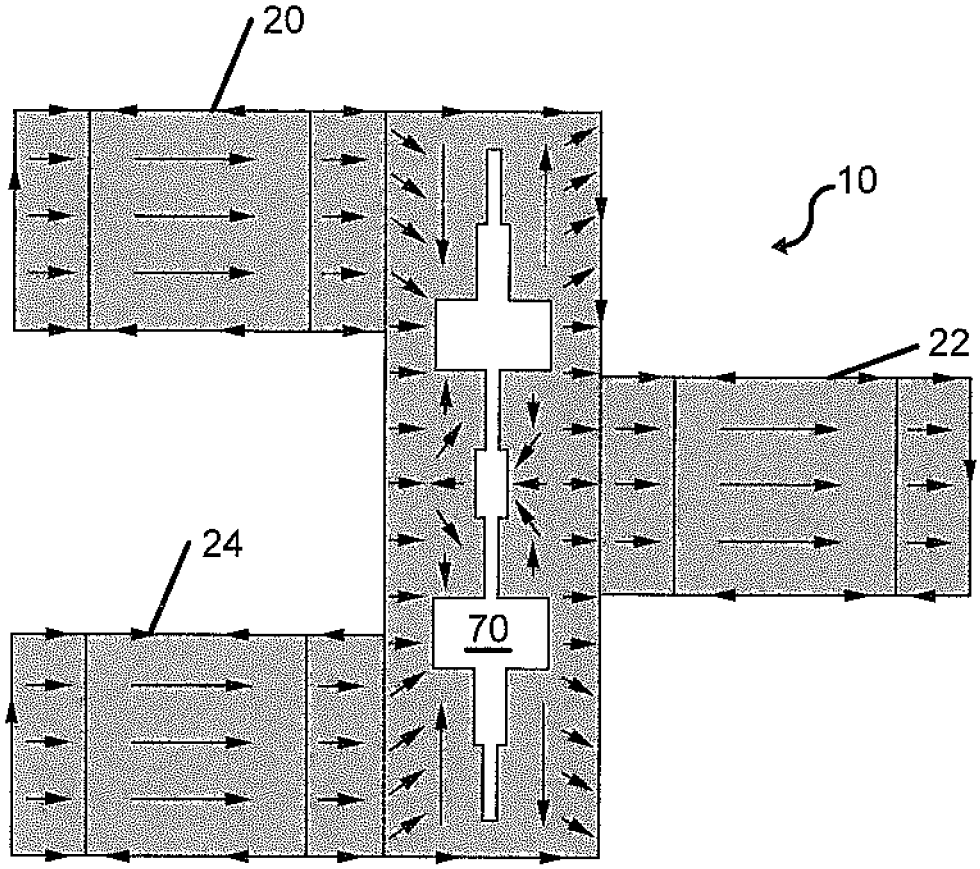
FIG. 15 depicts the slot antenna of the present invention unfurled to show surface current distribution at a center design frequency.
Figure 16:
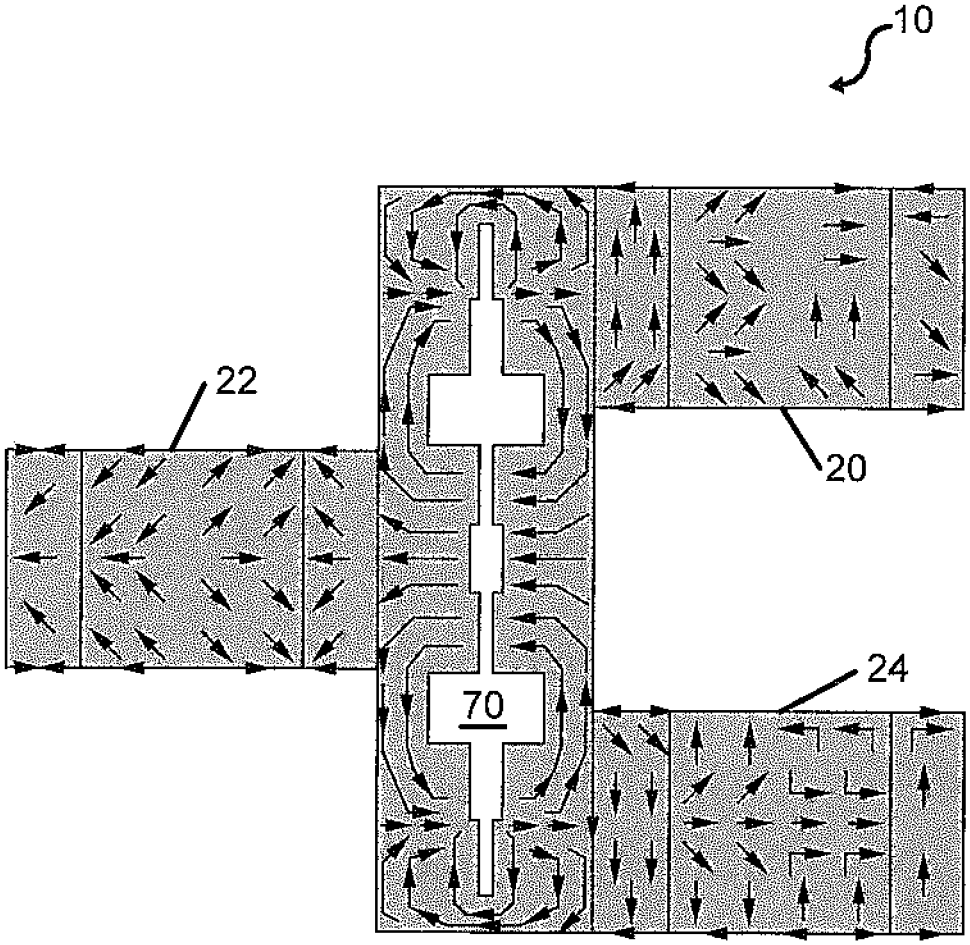
FIG. 16 depicts the slot antenna of the present invention unfurled to show surface current distribution at a frequency of 1.33 F0.

It can be seen in FIG. 14, FIG. 15 and FIG. 16 that the currents spread over the antenna surface in interesting ways, as the electrical size of the structure changes from submultiples to multiples of the design center frequency F0.

The advantage of the slot antenna 10 of the present is that the design does not require knowledge of the cutoff frequency to determine operating frequency. Only the slot length determines the operating frequency. This make possible the design of lower-frequency antennas previously thought unfeasible due to the large cylinder sizes required by cutoff considerations. Another advantage is that the radiative beam patterns of the slot antenna 10 are similar to a continuously metal-backed antenna.

It will be understood that many additional changes in the details, materials, steps and arrangement of parts, which have been herein described and illustrated in order to explain the nature of the invention, may be made by those skilled in the art within the principle and scope of the expressed in the appended claims.

What is claimed is:

1. A slot antenna comprising:

an aluminum first interdigital back plate, said first interdigital back plate being channel-shaped with a planar trough as well as a first plane extending perpendicular from said trough at a first linear edge of said trough with said first plane including at least two apertures and a second plane extending perpendicular at a first plane edge from said trough at a second linear edge of said trough with said second plane having a second plane edge and a rectangular spacer section extending from the second plane edge along a longitudinal length of said rectangular spacer section to be parallel to said trough and with said rectangular section having at least three circular indents perpendicular to said trough and wherein each of said planes has an equal width and a length equal to a length of said trough;

a first fiberglass insulator spacer having an L-shaped height and rectangular length, said first fiberglass insulator mechanically attached on a longer leg of the L-shape to the apertures of the first plane of said first interdigital back plate with said first insulator spacer having at least three apertures thru a shorter length of the L-shape;

an aluminum second interdigital plate spaced apart from and co-linear with said first interdigital plate at a planar end of said first interdigital plate, said second interdigital plate being channel-shaped with a planar trough as well as a first plane extending perpendicular at a first plane edge from said trough at a first linear edge of said trough and a second plane extending perpendicular from said trough at a second linear edge of said trough with said first plane having a second plane edge and a rectangular spacer section extending from the second plane edge along a longitudinal length of said rectangular spacer section to be parallel to said trough and with said rectangular section having at least three circular indents perpendicular to said trough and wherein each of said planes has an equal width and a length equal to a length of said trough of said second interdigital plate;

a second fiberglass insulator spacer having an L-shaped height and rectangular length, said second fiberglass insulator mechanically attached on a longer leg of the L-shape to the apertures of the second plane of said second interdigital back plate with said second insulator spacer having at least three apertures thru a shorter length of the L-shape;

an aluminum third interdigital back plate spaced apart from and co-linear with said second interdigital plate at a planar end of said second interdigital back plate, said third interdigital back plate being channel-shaped with a planar trough as well as a first plane extending perpendicular at a first plane edge from said trough at a first linear edge of said trough and a second plane extending perpendicular from said trough at a second linear edge of said trough with said second plane having a second plane edge and a rectangular spacer section extending from the second plane edge along a longitudinal length of said rectangular spacer section to be parallel to said trough and with said rectangular section having at least three circular indents perpendicular to said trough and wherein each of said planes has an equal width and a length equal to a length of said trough of said third interdigital back plate;

a third fiberglass insulator spacer having an L-shaped height and rectangular length, said third fiberglass insulator mechanically attached on a longer leg of the L-shape to the apertures of the first plane of said third interdigital back plate with said third insulator spacer having at least three apertures thru a shorter length of the L-shape;

a support stiffener as a longitudinal block having a first end and a second end with a first rectangular stanchion integral and perpendicular to the first end of said longitudinal block and a second rectangular stanchion integral and perpendicular to the second end of said longitudinal block wherein said support stiffener is affixed by a face of said longitudinal block to said trough of said first interdigital back plate, said trough of said second interdigital back plate and said trough of said third interdigital back plate;

a feed port bracket standoff adjacent to said second rectangular stanchion with said feed port bracket standoff as an L-shaped section with a base of said L-shaped section affixed to said third interdigital back plate to face outward from said third interdigital back plate;

a feed port bracket affixed to the outward faced L-shaped section of said feed port bracket standoff;

a third rectangular stanchion affixed perpendicular to a midpoint of said longitudinal block and in alignment with said first rectangular stanchion and said second rectangular stanchion;

a feed point of spaced apart and mirroring brackets with a leg of each of said brackets affixed to co-linear sides of said third rectangular stanchion and with a cone extending at a base from one bracket face to another bracket face of another leg of said mirroring brackets;

a feed cowl encompassing said extending cone and mirroring brackets affixed to said third rectangular stanchion; and a slotted plate having a first end and a second end with a longitudinal slot having a central aperture therebetween wherein said slotted plate is affixed to said first interdigital back plate in the circular indents of said first interdigital back plate and in the apertures of said first fiberglass insulator spacer with said slotted plate affixed to said second interdigital plate in the circular indents of said second interdigital back plate and in the apertures of said second fiberglass insulator spacer and with said slotted plate affixed to said third interdigital plate in the circular indents of said third interdigital back plate and in the apertures of said third fiberglass insulator spacer and wherein said slotted plate is affixed to said first rectangular stanchion and said second rectangular stanchion at ends opposite to being affixed on said support stiffener.

2. The slot antenna in accordance with claim 1 wherein the longitudinal slot of said slotted plate has a first configuration, a second configuration and a rectangular central aperture; and wherein the first configuration is shaped with a first rectangular aperture having an open end and a closed end with the closed end spaced apart from the first end of said slotted plate, a second rectangular aperture having a first open end aligned with the open end of the first rectangular aperture and having a second open end, a third rectangular aperture having a first open end aligned with the second open end of the second rectangular aperture and having a second open end; a fourth rectangular section having a first open end aligned with the second open end of the third rectangular aperture and having a second open end;

wherein the second configuration mirrors the shaping of the first configuration;

wherein the central aperture is positioned between the first configuration and the second configuration, the central aperture having a first open end aligned with the second open end of the fourth rectangular section of the first configuration and the central aperture having a second open end aligned with the second open end of the fourth rectangular section of the second configuration;

wherein a length and width of each rectangular aperture is measured by an operating wavelength λ.

3. The slot antenna in accordance with claim 2 wherein widths of the first rectangular aperture and fourth rectangular aperture are λ/33, a width of the second rectangular aperture is λ/17, a width of the third rectangular aperture is λ/5 and a length of each aperture is λ/8; and wherein a width of the center aperture is λ/17 and the length of the center aperture is λ/8.

4. The slot antenna in accordance with claim 3 wherein said support stiffener, said center support and said feed port bracket standoff are fiberglass.

5. The slot antenna in accordance with claim 4 wherein said feed port bracket is aluminum.

6. The slot antenna in accordance with claim 5 wherein said feed cowl is a Noryl polymer.

* * * * *